US005199832A

United States Patent [19]

Meskin et al.

[11] Patent Number: 5,199,832

[45] Date of Patent: Apr. 6, 1993

[54] MULTI-COMPONENT CUTTING ELEMENT USING POLYCRYSTALLINE DIAMOND DISKS

[76] Inventors: Alexander K. Meskin, 2955 Morningside Dr., Salt Lake City, Utah 84117; Clifford R. Pay, 2056 S. 775 West, Woods Cross, Utah 84087

[21] Appl. No.: 395,177

[22] Filed: Aug. 17, 1989

Related U.S. Application Data

[63] Continuation of Ser. No. 148,495, Jan. 26, 1988, abandoned, which is a continuation of Ser. No. 794,569, Nov. 4, 1985, abandoned, which is a continuation of Ser. No. 593,123, Mar. 26, 1984, abandoned.

[51] Int. Cl.[5] ..... E21B 10/58; B23B 27/20

[52] U.S. Cl. ..... 408/145; 51/206 R; 76/DIG. 12; 175/373; 175/434

[58] Field of Search ..... 408/145; 125/111 R, 125/39; 51/204, 206 R; 76/DIG. 11, DIG. 12, 101 R, 108 A; 175/329, 330

[56] References Cited

U.S. PATENT DOCUMENTS

| | | | |
|---|---|---|---|
| 3,440,773 | 4/1969 | Hawkes | 51/206 A |
| 3,885,637 | 5/1975 | Veprintsen et al. | 175/329 |
| 3,902,864 | 9/1975 | Nix et al. | 29/191.2 |
| 4,041,650 | 8/1977 | Sawluk | 51/206 R |
| 4,081,320 | 3/1978 | Fuller | 175/325 |
| 4,451,093 | 5/1984 | Perez | 125/40 |
| 4,452,325 | 6/1984 | Radd et al. | 76/108 R |
| 4,529,047 | 7/1985 | Meskin et al. | 175/329 |
| 4,537,097 | 8/1985 | Illerhaus et al. | 76/DIG. 12 |
| 4,726,718 | 2/1988 | Meskin et al. | 408/175 |

FOREIGN PATENT DOCUMENTS

| | | | |
|---|---|---|---|
| 2013198 | 3/1970 | Fed. Rep. of Germany . | |
| 233479 | 4/1969 | U.S.S.R. | 76/DIG. 12 |
| 632823 | 11/1978 | U.S.S.R. | 175/329 |
| 576757 | 4/1944 | United Kingdom . | |
| 2044146 | 10/1980 | United Kingdom . | |
| 2107298 | 4/1983 | United Kingdom | 408/145 |
| 2115460 | 9/1983 | United Kingdom | 175/329 |

*Primary Examiner*—Hien H. Phan

[57] ABSTRACT

A diamond cutting table having the geometric characteristics of larger unleached diamond compact products and yet characterized by the physical properties of smaller leached diamond products is fabricated by forming a diamond cutter incorporating a plurality of polycrystalline diamond (PCD) leached disks. The PCD leached disks are disposed in array in a cutting slug formed of matrix material. The matrix material is disposed between and around the plurality of diamond disks and in one embodiment incorporates a volume distribution of diamond grit. The cutting slug is hot pressed or infiltrated to form an integral mass or table. The diamond table is then bonded to a cutter or directly molded into an integral tooth within a matrix body bit.

14 Claims, 1 Drawing Sheet

Fig. 1
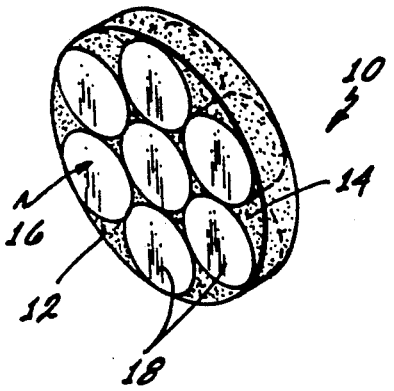
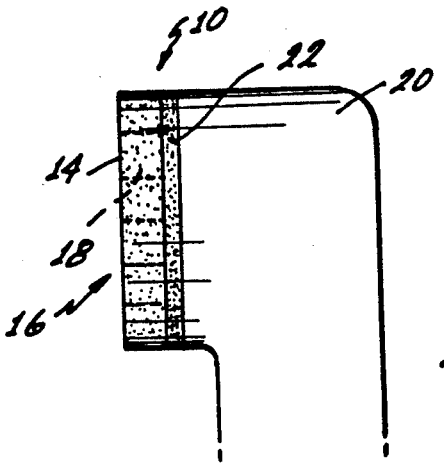
Fig. 2
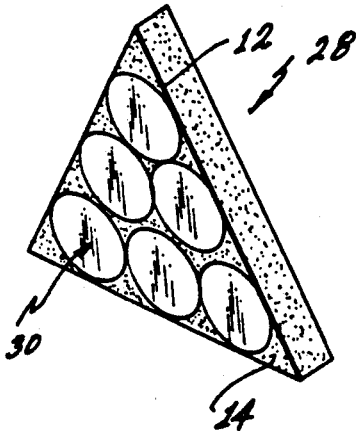
Fig. 4
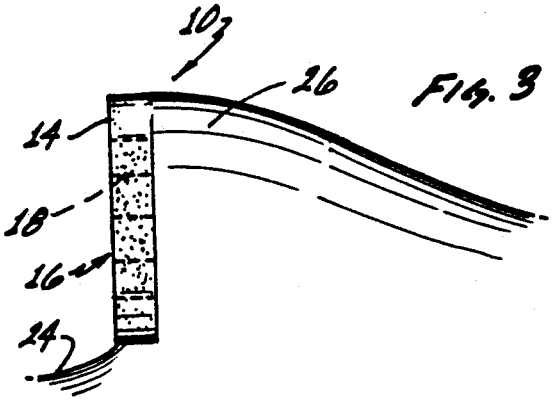
Fig. 3
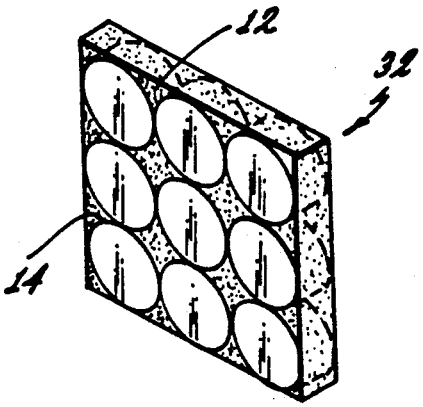
Fig. 5

MULTI-COMPONENT CUTTING ELEMENT USING POLYCRYSTALLINE DIAMOND DISKS

This is a continuation of application Ser. No. 148,495, filed Jan. 26, 1988, now abandoned, which is a continuation of application Ser. No. 794,569 filed Nov. 4, 1985, now abandoned, which is a continuation of application Ser. No. 593,123 filed Mar. 26, 1984, now abandoned.

BACKGROUND OF THE INVENTION

1. Field of the Invention

The present invention relates to the field of earth boring tools and in particular relates to diamond cutters used on rotary bits.

2. Description of the Prior Art

Rotating diamond drill bits were initially manufactured with natural diamonds of industrial quality. The diamonds were square, round or of irregular shape and fully embedded in a metallic bit body, which was generally fabricated by powder metallurgical techniques. Typically, the natural diamonds were of a small size ranging from various grades of grit to larger sizes where natural diamonds of 5 or 6 stones per carat were fully embedded in the metal matrix. Because of the small size of the natural diamonds, it was necessary to fully embed the diamonds within the matrix in order to retain them on the bit face under the tremendous pressures and forces to which a drill bit is subjected during rock drilling.

Later, the commercial production of synthetically produced diamond grit and polycrystalline stones became a reality. For example, synthetic diamond was sintered into larger disk shapes and were formed as metal compacts, typically forming an amalgam of polycrystalline sintered diamond and cobalt carbide. Such diamond tables are commercially manufactured by General Electric Company under the trademark STRATAPAX. The diamond tables are bonded, usually within a diamond press to a cobalt carbide slug and sold as an integral slug cutter. The slug cutters are then attached by the drill bit manufacturers to a tungsten carbide slug which is fixed within a drill bit body according to the design of the bit manufacturer.

However, such prior art polycrystalline diamond (PCD) compact cutting slugs are characterised by a low temperature stability. Therefore, their direct incorporation into an infiltrated matrix bit body is not practical or possible.

In an attempt to manufacture diamond cutting elements of improved hardness, abrasion resistance and temperature stability, prior art diamond synthesizers have developed a polycrystalline sintered diamond element from which the metallic interstitial components, typically cobalt, carbide and the like, have been leached or otherwise removed. Such leached polycrystalline synthetic diamond is manufactured by the General Electric Company under the trademark GEOSET, for example 2102 GEOSETS, which are formed in the shape of an equilateral prismatic triangle 4 mm on a side and 2.6 mm deep (3 per carat), and as a 2103 GEOSET shaped in the form of an equilateral triangular prismatic element 6 mm on a side and 3.7 mm deep (1 per carat). However, due to present fabrication techniques, in order to leach the synthetic sintered PCD and achieve the improved temperature stability, it is necessary that these diamond elements be limited in size. Therefore, whereas the diamond compact slug cutters, STRATAPAX, may be formed in the shape of circular disks of ⅜" (9.5 mm) to ½" (12.7 mm) in diameter, the leached triangular prismatic diamonds, GEOSETS, have maximum dimensions of 4 mm to 6 mm. It is well established that the cutting rate of a diamond rotating bit is substantially improved by the size of the exposed diamond element available for useful cutting. Therefore, according to the prior art, the increased temperature stability of leached diamond products has been achieved only at the sacrifice of the size of the diamond elements and therefore the amount of diamond available in a bit design for useful cutting action.

What is needed then is a PCD cutter which is characterised by the temperature stability and characteristics of leached diamond products, and yet has the size available for useful cutting action which is characterised by the larger unleached diamond products.

BRIEF SUMMARY OF THE INVENTION

The invention is a cutter for use in a drill bit comprising a plurality of thermally stable PCD disks. A cutting slug is formed of matrix material and the plurality of diamond disks are disposed in the cutting slug. The matrix material also incorporates diamond grit in at least that portion of the cutting in the proximity where the diamond disks are exposed, namely the cutting face of the cutter. By reason of this combination of elements, an enlarged cutter is fabricated for mounting within the drill bit.

In particular, the invention is a diamond cutter in a rotary bit comprising a plurality of circular leached PCD prefabricated synthetic disks each having at least one end surface. A cutting slug is formed of matrix material and the plurality of PCD disks are disposed in the cutting slug. The matrix material fills the interstitial spaces between the plurality of PCD disks. The cutting slug is further characterised by having a cutting face wherein the one end surface of each of the PCD disks is fully exposed on the cutting face. The matrix material, which forms the cutting slug, further comprises and includes diamond grit which is incorporated at least in that portion of the cutting slug in the proximity of the cutting face. Preferably, the diamond grit is uniformly dispersed throughout the matrix material. By reason of this combination of elements, an enlarged diamond table is provided as a cutter for mounting the rotary bit.

These and other embodiments of the invention are best understood by considering the following drawings wherein like elements are referenced by like numerals.

BRIEF DESCRIPTION OF THE DRAWINGS

FIG. 1 is a perspective view of a multicomponent cutting element formed in the shape of a circular disk according to the invention.

FIG. 2 is a side sectional view of the disk illustrated in FIG. 1 shown as attached to a stud cutter.

FIG. 3 is a side sectional view of a multicomponent cutting element of the type shown in FIG. 1 mounted in matrix tooth integrally formed in an infiltrated matrix bit.

FIG. 4 is a perspective view of a second embodiment of the invention showing a triangular shaped multicomponent cutting element.

FIG. 5 is a third embodiment of the invention showing a perspective view of a multicomponent rectangular shaped cutting element.

These and other embodiments can best be understood by viewing the above drawings in light of the following description.

DETAILED DESCRIPTION OF THE PREFERRED EMBODIMENTS

The invention is an enlarged diamond cutter comprised of a plurality of right circular cylindrical thermally stable or leached PCD disks arranged in array within a cutting slug or table. The slug in turn is comprised of metallic powder which is infiltrated, molded or pressed about the array of PCD disks to form an amalgamated integral mass. The multiple edges of the PCD disks tend to increase the total diamond cutting perimeter.

The invention can better be understood by turning first to the illustrated embodiment of FIG. 1. In FIG. 1 a perspective view of a diamond table or cutting slug, generally denoted by reference numeral 10, is depicted. Cutting slug 10 is comprised of an array of PCD elements 12. In the illustrated embodiment, elements 12 are right, circular cylindrical disks which are comprised of leached polycrystalline synthetic diamond formed in a diamond press. Such material is of substantially the same composition as synthetic diamond made and sold by General Electric Company under the trademark GEOSET, or by various Ministries of the Peoples of the People's Republic of China. In the case of synthetic diamond material available from China, the diamond stock is sold in rod-like cylindrical shapes of approximately 0.07 inch (2.00 mm) to 0.394 inch (10.0 mm) in length and 0.078" to 0.315" (2 mm to 8 mm) in diameter. These rod-like shapes can then be sectioned to form cylindrical disk elements 12 to any desired thickness by laser-cutting, electrodischarge machining or other equivalent means. For example, in the illustrated embodiment, disk diamond elements 12 are 0.157" (4 mm) in diameter and 0.039" (1 mm) thick.

Cutting slug 10 in the embodiment of FIG. 1 has an overall geometric shape of a right circular cylindrical disk. In the illustrated embodiment, the thickness of cutting slug 10 is substantially equal to the thickness of diamond elements 12, although it could be increased or decreased if desired. Diamond elements 12 are disposed in cutting the slug 10 in an array which may be compactly formed, wherein each diamond element 12 contacts or is immediately proximate to at least one adjacent diamond element. PCD elements in the invention in a compact array may actually touch each other or may be separated by a thin layer of matrix material which tends to bond the adjacent elements together. For the purposes of this specification, either situation or its equivalent shall be defined as an "immediately proximate" configuration.

Alternatively, the array of diamond elements 12 could be placed within cutting slug 10 in a spaced apart relationship so that no two adjacent elements contacted each other and the interstitial space between diamond elements 12 is completely filled by matrix material 14. In addition, diamond coverage can be extended by using fractional portions of whole discs where appropriate. Matrix material 14 is an amalgam of powdered metals well known to the art, principally comprised of tungsten carbide. Other elements and compounds may be added as well to effect the physical/chemical properties of matrix material 14 as required.

The invention is particularly characterised in that matrix material 14 also incorporates natural or synthetic diamond grit. Any mesh or grit size well known to the art may be used according to the required performance characteristics as determined by well known principles. In general, a grit size of 0.01 inch (0.00254 mm) to 0.05 (1.27 mm) inch in diameter is employed. A diamond grit incorporated or impregnated within matrix material 14 is disposed therein in a dispersion at least within that portion of matrix material 14 forming a layer near cutting face 16 of cutting slug 10. In the preferred embodiments, the grit is uniformly distributed throughout the volume of the matrix material at a concentration of 50% to more by volume Cutting face 16 is thus comprised of the exposed end faces 18 of each diamond element 12 and the interstitial exposed surface of diamond bearing matrix material 14. In the illustrated embodiment, diamond grit is substantially uniformly dispersed throughout the entire volume of matrix material 14 and not merely in the proximity of cutting face 16.

Cutting slug 10 of the embodiment of FIG. 1 may be fabricated by conventional hot pressing or infiltration techniques. Consider first fabrication by hot pressing. A carbon mold, in which a right circular cylindrical cavity is defined, is fabricated with movable end pieces or anvils. Polycrystalline synthetic diamond elements 12, which are prefabricated, typically in a diamond press, are then placed within the cylindrical cavity defined in the carbon mold. The placement may be in a compact array or spaced apart array or such other arrangement as may be deemed appropriate. Thereafter, powder metal in which the diamond grit is uniformly mixed is placed in the mold between diamond elements 12 and at least above or below the elements. A greater depth of the diamond bearing matrix powder is loaded in the mold, than the thickness of diamond elements 12 in order to account for the higher compressability of the matrix powder as compared to synthetic polycrystalline diamonds 12. Sealing anvils are then placed on top or bottom or both ends of the cylindrical cavity of the filled carbon mold and the mold and anvils are then placed within a hot press. The filled mold and its contents are then heated by a conventional induction heater and subjected to pressure. The pressure and temperature causes the matrix powder to amalgamate and compress to form the circular disk depicted as cutting slug 10 in FIG. 1. The pressures and temperatures used in the hot press are well outside the diamond synthesis phase regions and no appreciable amount of diamond is either synthesized or converted into graphite during the process. For example, a pressure of 200 psi is exerted upon the contents of the filled mold which is held at 1900° F. for 3 minutes. The result is a multi-component array of PCD elements 12 in a circular cylindrical disk 10 of approximately 0.512" (13 mm) in diameter.

The same disk may be fabricated by conventional infiltration techniques wherein diamond elements 12 are again set within a carbon mold which is backfilled with matrix powder. The filled mold is then pressed and the powder allowed to settle and infiltrate to form an amalgamated sintered mass having the shape as defined by the mold.

Turn now to FIG. 2 wherein cutting slug 10 is shown in sectional side view. Cutting slug 10 may be bonded by soldering or brazing to a steel or tungsten carbide stud 20 well known to the art. Stud 20 in turn is disposed within a drill bit body by press fitting, brazing or other well known methods. Cutting slug 10 in the illustrated embodiment is bonded to stud 20 by braze or solder forming a bonding layer 22 shown in exaggerated sectional view in FIG. 2. Cutting face 16 is thus fully exposed and provides the useful cutting surface. Therefore, by using high temperature-stable and improved leached diamond elements 12, an enlarged cutting slug 10 of a size comparable or greater than presently available diamond compact cutters, such as STRATAPAX cutters, can be employed in conventional bit designs or in combination with conventional stud cutters as illustrated in FIG. 2.

FIG. 3 shows a side sectional view of cutting slug 10 as disposed within an infiltrated matrix body bit. Only the tooth portion of the matrix body is illustrated. Cutting slug 10 is disposed in a carbon mold according to conventional infiltration techniques. Thereafter, the mold is filled with a metal matrix. The filled mold is then furnaced allowing the metallic powder to become sintered and infiltrate downward through the mold to form an integral mass. As illustrated in FIG. 3, cutting slug 10 thus becomes bonded to the integral mass of the matrix body and is embedded therein according to the bit design and tooth structure defined within the mold. For example, in the illustrated embodiment of FIG. 3, cutting slug 10 is fully exposed above surface 24 of the bit and is provided with a trailing, integrally formed portion 26 to provide a backing and support for cutting slug 10. Cutting face 16 thus is fully exposed and forms the forward moving surface of the composite tooth structure that is characterised by an overall size and geometric shape heretofore characterised only by diamond compact stud cutters which could not be fabricated within an infiltration matrix bit because of their poor thermal stability. Cutting slug 10 is characterized by a cutting face 16 wherein diamond grit is disposed into the matrix material only in that portion of cutting slug 10 in the proximity of cutting face 16.

Turn now to the second embodiment of FIG. 4 wherein a cutting slug, generally denoted by reference numeral 28, is formed in the shape of a triagular table. Again, a plurality of synthetic PCD right circular disks 12 are disposed within cutting slug 28. Diamond elements 12 are disposed in an array which may either be compactly formed or spaced-apart. The interstitial space between and about diamond elements 12 within cutting slug 28 is comprised of a metallic diamond bearing matrix 14 described above. As before, diamond elements 12 have at least one circular end face exposed on cutting face 30 of cutting slug 28. The thickness of slugs 28 may be substantially equal to the thickness of diamond elements 12. Again, cutting slug 28 may be formed by conventional hot press or infiltration techniques and then mounted on a stud in the manner as shown in connection with FIG. 2 or directly disposed within an infiltrated matrix body bit as described in connection with FIG. 3.

FIG. 5 illustrates a third embodiment of the invention wherein a diamond table or cutting slug, generally denoted by a reference numeral 32, is formed in a rectangular or square shape. The same circular diamond elements 12 as described above are disposed within cutting slug 32 in an array with the interstitial spaces between and around diamond elements 12 filled with a diamond bearing matrix material 14. The embodiment of FIG. 5 differs only from that of FIG. 4 and FIG. 1 by the overall gross geometric outline of the cutting slug and not by any detail of its constituents or mode of fabrication. Again, the cutting slug is fabricated using infiltration or hot press techniques and can then be mounted on a stud cutter in the manner briefly described in FIG. 2 or directly in a matrix bit as suggested in FIG. 3.

Many alterations and modifications may be made by those having ordinary skill in the art without departing from the spirit and scope of the invention. The illustrated embodiment has been shown only for the purposes of clarity and example and should not be taken as limiting the invention which is defined in the following claims.

We claim:

1. A cutting structure for a rotary drag bit for earth boring, comprising:

a cutting slug fixedly mounted on said bit and including a substantially planar cutting surface, said slug comprising:

a plurality of laterally juxtaposed thermally stable polycrystalline diamond cutting elements in the shape of cylindrical discs having mutually parallel axes; and a metal matrix binder laterally interposed between said cylindrical discs and defining with the ends thereof said substantially planar cutting surface predominantly comprising said ends.

2. The cutting structure of claim 1, wherein said diamond cutting elements are each in lateral contact with at least one other diamond cutting element.

3. The cutting structure of claim 1, wherein said diamond cutting elements are each in lateral contact with at least two other diamond cutting elements.

4. The cutting structure of claim 1, wherein said cutting structure further includes a carrier element backing and supporting said cutting slug and providing a fixed orientation for said substantially planar cutting surface with respect to said rotary drag bit.

5. The cutting structure of claim 4, wherein said carrier element comprises a stud disposed on said rotary drag bit.

6. The cutting structure of claim 4, wherein said rotary drag bit comprises an infiltrated matrix body bit, and said carrier element comprises an integrally formed protrusion on said bit body.

7. The cutting structure of claim 1, wherein said axes of said diamond cutting elements and said substantially planar cutting surface are in substantially mutually perpendicular orientation.

8. A cutting structure mounted on a rotary drag bit for earth boring, comprising:

a cutting slug including a metal matrix binder having disposed therein a plurality of cutting elements and defining therewith a substantially planar cutting surface predominantly comprised of said cutting elements;

said cutting elements being comprised of thermally stable polycrystalline diamond in the form of right circular cylinders, the cutting elements being laterally juxtaposed and having mutually parallel axes, the ends of said cylinders providing the portion of said cutting surface predominantly comprised of said cutting elements.

9. The cutting structure of claim 8, wherein said diamond cutting elements are each in lateral contact with at least one other diamond cutting element.

10. The cutting structure of claim 8, wherein said diamond cutting elements are each in lateral contact with at least two other diamond cutting elements.

11. The cutting structure of claim 8, wherein said cutting structure further includes a carrier element adapted to back and support said cutting slug and to provide a fixed orientation therefor with respect to said rotary drag bit.

12. The cutting structure of claim 11, wherein said carrier element comprises a stud disposed on said rotary drag bit.

13. The cutting structure of claim 11, wherein said rotary drag bit comprises an infiltrated matrix body bit, and said carrier element comprises an integrally formed protrusion on said bit body.

14. The cutting structure of claim 8, wherein said axes of said diamond cutting elements and said substantially planar cutting surface are in substantially mutually perpendicular orientation.

* * * * *

UNITED STATES PATENT AND TRADEMARK OFFICE

CERTIFICATE OF CORRECTION

PATENT NO. : 5,199,832
DATED : April 6, 1993
INVENTOR(S) : Meskin, et. al.

It is certified that error appears in the above-indentified patent and that said Letters Patent is hereby corrected as shown below:

On the Title page, item [54] in the title, change "COMPONENT" to --COMPONENT--;

Column 4, line 12, after "volume" insert --.--;

Signed and Sealed this

Twenty-second Day of February, 1994

*Attest:*

Bruce Lehman

BRUCE LEHMAN

*Attesting Officer*

*Commissioner of Patents and Trademarks*